US008925157B2

(12) United States Patent
O'Daniel

(10) Patent No.: US 8,925,157 B2
(45) Date of Patent: Jan. 6, 2015

(54) FRONT TO BACK REVERSIBLE MULTIPLE PLANAR PAPER CLIP WITH DOUBLE CLIPPING EFFECT

(75) Inventor: Tod Michael O'Daniel, Thousand Oaks, CA (US)

(73) Assignee: Tod M. O'Daniel, Thousand Oaks, CA (US)

( * ) Notice: Subject to any disclaimer, the term of this patent is extended or adjusted under 35 U.S.C. 154(b) by 859 days.

(21) Appl. No.: 12/807,209

(22) Filed: Aug. 31, 2010

(65) Prior Publication Data

US 2012/0047698 A1 Mar. 1, 2012

(51) Int. Cl.
*B42F 1/08* (2006.01)

(52) U.S. Cl.
CPC .. *B42F 1/08* (2013.01); *Y10S 24/09* (2013.01); *Y10S 24/10* (2013.01)
USPC ..... 24/67.9; 24/DIG. 9; 24/DIG. 10

(58) Field of Classification Search
USPC ..... 24/67.3, 67.9, 546, 547, DIG. 8, DIG. 9, 24/DIG. 10
See application file for complete search history.

(56) References Cited

U.S. PATENT DOCUMENTS

| | | | | | |
|---|---|---|---|---|---|
| 758,547 | A | * | 4/1904 | Mapother | 24/DIG. 10 |
| 763,303 | A | * | 6/1904 | Mayers | 24/67.9 |
| 1,053,008 | A | * | 2/1913 | Carbis | 24/DIG. 10 |
| 1,099,819 | A | * | 6/1914 | Ray | 24/67.9 |
| 1,310,587 | A | * | 7/1919 | Sumersille | 24/67.9 |
| 1,336,626 | A | | 9/1920 | Hall | |
| 2,052,887 | A | | 9/1936 | Lewis | |
| 4,949,435 | A | | 8/1990 | Michelson | |
| 5,655,266 | A | * | 8/1997 | Gish | 24/67.9 |

* cited by examiner

*Primary Examiner* — Robert J Sandy

(57) ABSTRACT

In accordance with at least one embodiment, a clamp is being formed of a length of metallic or composite wire, primarily for securing a plurality of paper of sheet material. Two independent spline portions are disposed between two respective independent planar end portions with a planar body. The body consists of two legs and a connector. Each end portion makes two points of contact with each respective leg and is capable of having a load of potential energy in a free state. The end portions each overlap the body and are capable of being inwardly flipped to an opposing major planar face of the body. The end portions may each be manually bent away from the opposing face, and be brought back to rest on the original face of the body. This operation increases a holding strength, spring load or potential energy. Double and single clamping effects are provided.

15 Claims, 5 Drawing Sheets

FRONT TO BACK REVERSIBLE MULTIPLE PLANAR PAPER CLIP WITH DOUBLE CLIPPING EFFECT

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field of Invention

This application relates to paper or sheet material clips and clamps.

2. Prior Art

People have commonly used paper clips and clamps for securing a plurality of sheet material in places of business, school, home, and anywhere paper or sheet material is used. The never patented traditional Gem paper clip that was invented around nineteen hundred, has only three bends, one substantial plane, narrow asymmetrical "U" shapes, and can be seen as a long, narrow spiral. The clip lacks much capacity and twists on even moderate amounts of sheet material. This undesirable effect leaves a consumer with weak security. Also, wire ends are left to drag across areas of paper that can tear documents. Thereafter, several types of clips and clamps were designed to have increased capacity, paper friendliness, and holding strength. In 1920, U.S. Pat. No. 1,336,626 to Hall, disclosed an overlapping Ideal clamp for toy construction and having an increased capacity. However, a small one is not made as a paper clip. This is because one, once deformed, is not easily re-powered or spring loaded. A lasting quality is lost. In 1936, U.S. Pat. No. 2,052,887 to Lewis, disclosed a substantially planar paper clip, not easily tangled with others. However, this clip does not work on small amounts of paper even when made in even a moderately large sizes because no backing or overlapping is present. This is probably the reason why one is only made in hard to use, very small sizes today.

SUMMARY

In accordance with at least one embodiment, a clamp of the present patent is primarily for securing superimposed paper or sheet material. Two independent end portions each overlap two respective legs. A connector having at least one bend connects the legs. A body consists of the two legs and the connector. Two independent spline portions provide communication between the two respective end portions and the body. Each end portion makes two points of contact with each respective leg. The clamp is capable of being loaded with potential energy in free state. The end portions are capable of being inwardly moved or flipped from an original major planar face of the body to an opposing major planar face of the body. The end portions are capable of a manual adjustment of increasing holding strength, spring load, or potential energy by being manually bent away from the opposing face of the body, and brought back to the original face of the body. A longitudinal end of the body opposite the two splines is used as a tongue that is applicable to a side or a major planar face of the sheet material. The end portions are able to be urged to an opposing major planar face of the sheet material thereby providing a primary double clamping effect. The end portions are able to be individually applied to the sheet material thus providing single clamping effects. An unfathomable number of forms or embodiments follow the functions of the present patent such as described in the ramification section.

BRIEF DESCRIPTION OF THE DRAWING FIGURES

FIG. 1 C shows an end view of planar variation.

Figure 2A:
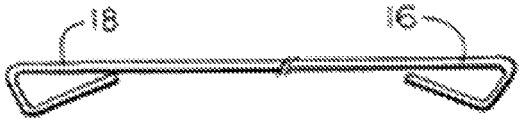

FIG. 2A shows a top view bending of end portions 16, 18.

Figure 2C:
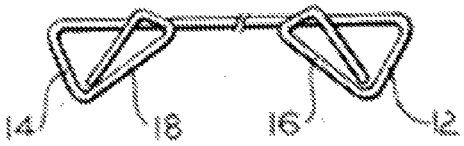
Figure 2B:
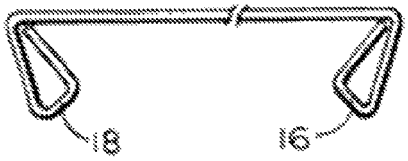

FIG. 2B shows a top view finishing end portion bends 16, 18.

FIG. 2C shows a top view of end portions 16, 18 overlapping middle portion 10.

Figure 2D:
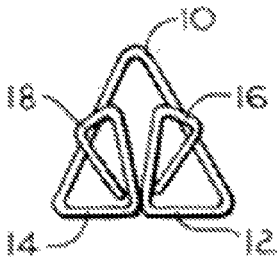

FIG. 2D shows a top view of body 10 bending.

Figure 3A:
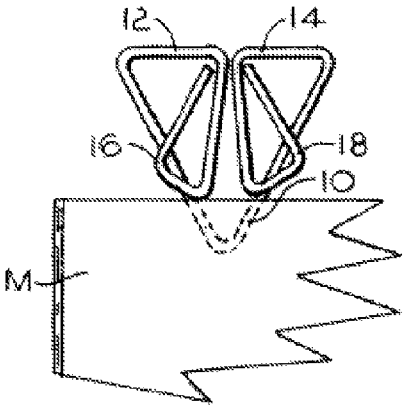

FIG. 3A shows a top view of the First Embodiment and body 10 against sheet material M.

Figure 3B:
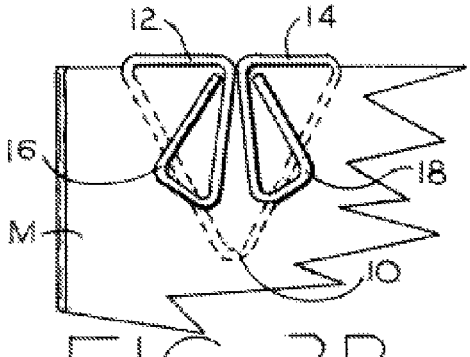

FIG. 3B shows a top view of the First Embodiment fully applied to sheet material M.

Figure 3D:
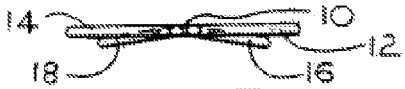
Figure 3C:
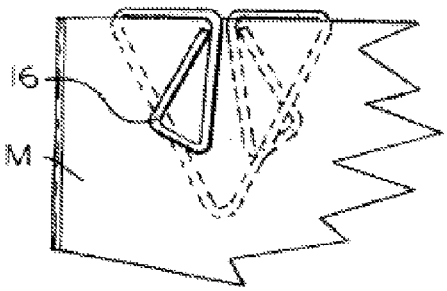

FIG. 3C shows a top view of a single clipping effect of end portion 16.

FIG. 3D shows an end view of end portions 16, 18 capable of contacting body 10.

Figure 3E:
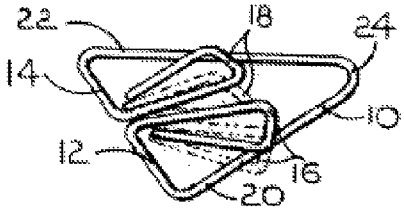

FIG. 3E shows a perspective view of a spring loading.

Figure 3F:
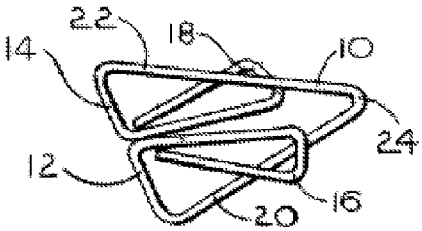

FIG. 3F shows a perspective view of end portion 18 moved or flipped to an opposing face of body 10.

Figure 3G:
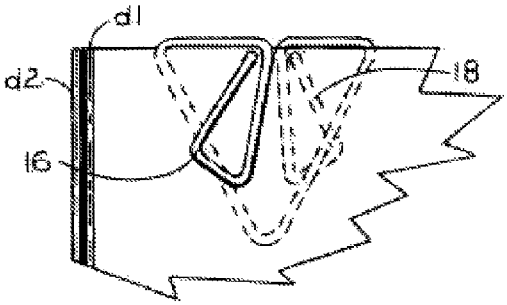

FIG. 3G shows a top view of The First Embodiment clamping two documents separately.

Figure 3H:
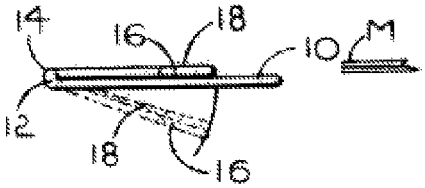

FIG. 3H shows a side view of the spring loading of perspective view FIG. 3E.

Figure 4:
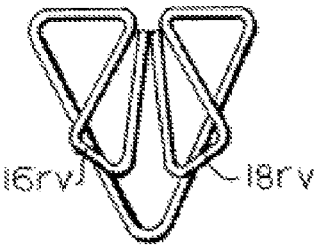

FIG. 4 shows a top view of an exemplary Reverse Loop embodiment.

Figure 5:
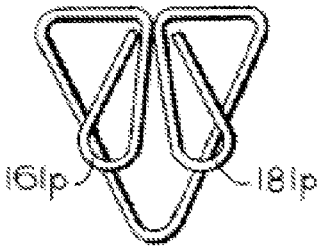

FIG. 5 shows a top view of an exemplary Simple Loop embodiment.

Figure 6:
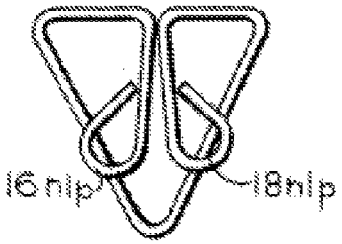

FIG. 6 shows a top view of an exemplary Narrowing Loop embodiment.

Figure 7:
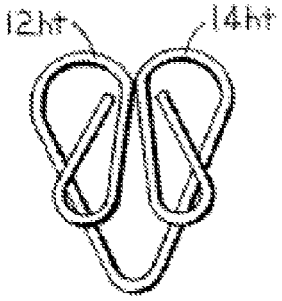

FIG. 7 shows a top view of an exemplary Heart embodiment.

Figure 8:
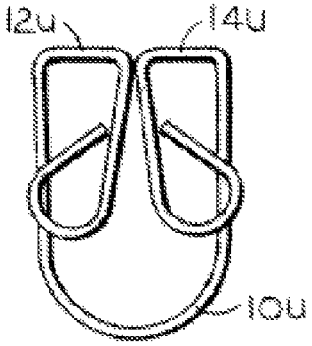

FIG. 8 shows a top view of an exemplary U Shape Middle Portion embodiment.

Figure 9:
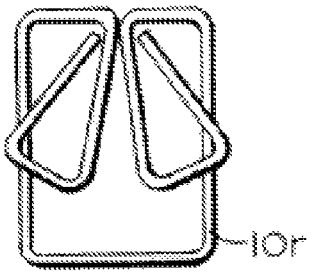

FIG. 9 shows a top view of an exemplary Rectangular embodiment.

Figure 10A:
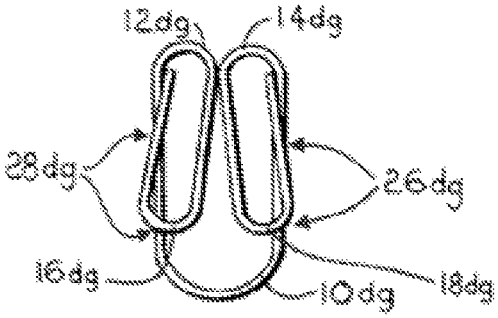

FIG. 10A shows a top view of a Double Gem embodiment.

Figure 10B:
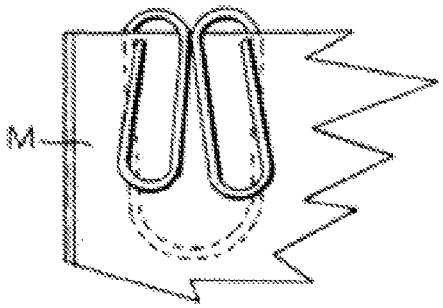

FIG. 10B shows a top view of the Double Gem embodiment and sheet material M.

Figure 11:
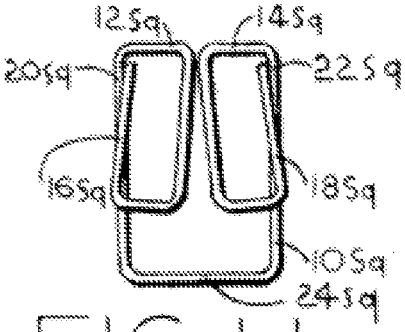

FIG. 11 shows a top view of an exemplary Squaring Double Gem embodiment.

Figure 12:
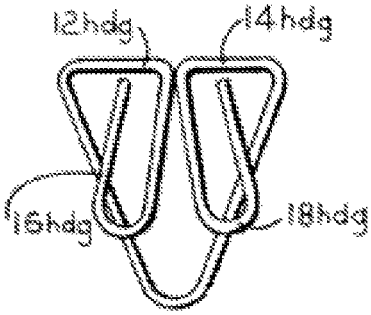

FIG. 12 shows a top view of an exemplary Triangular Double Gem embodiment.

Figure 13:
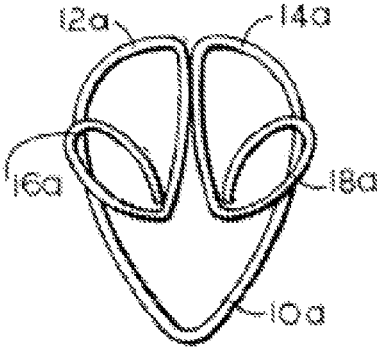

FIG. 13 shows a top view of an exemplary Alien Cartoon Character.

Figure 14:
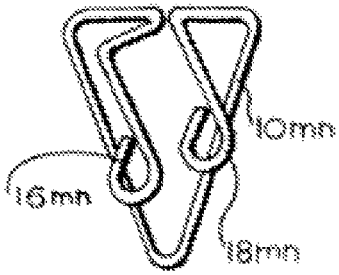

FIG. 14 shows a top view of an exemplary Music Notes Symbol embodiment.

Figure 15:
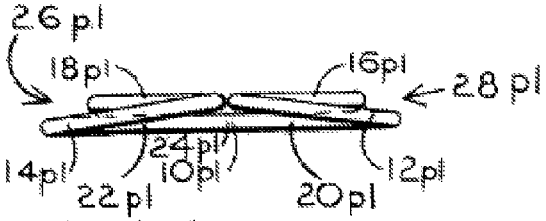

FIG. 15 shows an exemplary end view interchangeable with the end view of FIG. 1 B through slight spline portion adjustment.

Figure 16:
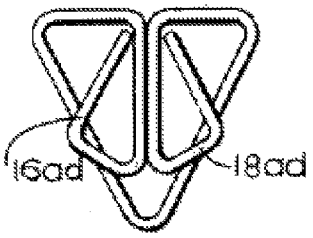

FIG. 16 shows a top view of a Laterally Adjacent End Portion example.

Figure 17:
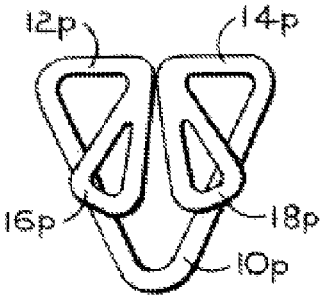

FIG. 17 shows a top view of an exemplary Plastic Embodiment.

DRAWINGS

Reference Numerals

10, 10*u*, 10*r*, 10*dg*, 10*sq*, 10*a*, 10*nm*, 10*pl*, 10*p*—body
12, 12*ht*,12*u*, 12*dg*, 12*sq*, 12*hdg*, 12*a*, 12*pl*, 12*p*—spline portion
14, 14*ht*,14*u*, 14*dg*, 14*sq*, 14*hdg*, 14*a*, 14*pl*, 14*p*—spline portion
16, 16*rv*, 161*p*, 16*nlp*, 16*dg*, 16*sq*, 16*hdg*, 16*a*, 16*nm*, 16*pl*, 16*ad*, 16*p*—end portion
18, 18*rv*, 181*p*, 18*nlp*, 18*dg*, 18*sq*, 18*hdg*, 18*a*, 18*nm*, 18*pl*, 18*ad*, 18*p*—end portion
20, 20*sq*, 20*pl*—leg 22, 22*sq*, 22*pl*—leg 24, 24*sq*, 24*pl*—connector
M—paper or sheet material
26, 26*dg*, 26*pl*—two points of contact
28, 28*dg*, 28*pl*—two points of contact
30—one point of contact
32—one point of contact

FIRST EMBODIMENT

FIG. 1A-FIG. 1C, FIG. 2A-FIG. 2D, FIG. 15, FIG. 3D, FIG. 3E, FIG. 3F, FIG. 3H

Figure 1A:
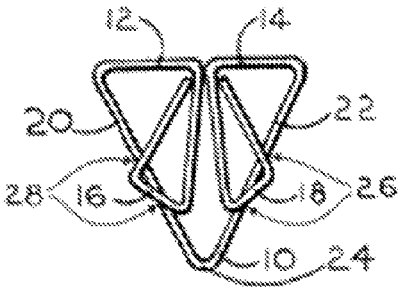
FIG. 1A shows a top view of the First Embodiment.
Figure 1B:
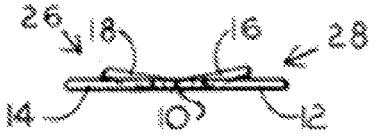
FIG. 1B shows an end view of the First Embodiment.
Figure 1C:
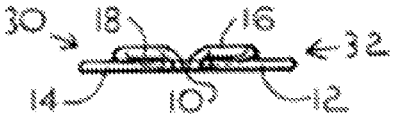

An overall view of an embodiment is shown in FIG. 1A (top view) with two end portions 16, 18 overlapping a body 10 that is forming a "V" shape. Body 10 consists of legs 20, 22 and a connector 24 having one bend (FIG. 1A). Spline portion 12 independently connects and communicates end portion 16 to body 10, and spline portion 14 independently connects and communicates end portion 18 to body 10 (FIG. 1A, FIG. 1B). Each of end portions 16, 18 form a loop and overlap each of respective legs 20, 22 of body 10 (FIG. 1A). Each of end portions 16, 18 makes two points of contact 26, 28 with each of respective legs 20, 22 such as shown in FIG. 1B, FIG. 15 (end views). End portions 16, 18 are loaded with a holding strength, spring load or potential energy such as illustrated in FIG. 3E (perspective view) and FIG. 3H (side view of FIG. 3E). End portions 16, 18 may be made to have a spring load on the opposing major planar face of body 10, as spline portions 12, 14 are in plane with body 10 (FIG. 3D, FIG. 3E (directionally opposite)). End portions 16, 18 are shown as independent (FIG. 3F). Each of end portions 12, 14 may be made to have a spring load in opposing directions as spline portions are in plane with body 10 (FIG. 3F, FIG. 3E (end portion 18 directionally opposite)). Having only one point of contact 30, 32 by each of end portions 16, 18 on each of respective legs 20, 22 is being shown in the planar relationships of end view FIG. 1C. The planar relationships of FIG. 1B and FIG. 1C are shown as interchangeable with each other, being recognizable as a twisting of end portions 16, 18. End portions 16, 18 have an alternate position shown with phantom lines (FIG. 3E). The alternate position of end portions 16, 18 is pivotal on spline portions 12, 14 (FIG. 3E, FIG. 3H). Exemplary, or one way of tooling, is shown with the bends closest to the ends of a pre-determined length of metallic or composite wire bending into loop shapes (FIG. 2A). Working from both ends of the wire strand to the center of the wire strand, end portions 16, 18 are being wedged or loaded onto middle portion 10, and overlapping (FIG. 2C, FIG. 1B, FIG. 3E). Body 10 is bent, bringing the embodiment together (FIG. 2D, FIG. 1B). Body 10 portion is shown broken to indicate wire length is not to scale for a finished clip (FIG. 2A-FIG. 2C). A proper wire length of an embodiment is having a proper overall length (or overall clamp size) to wire diameter ratio. A wire length having a clamp of about one and one-half inch across spline portions 12, 14 laterally, by a body of about one and one-half inch longitudinally is for a wire diameter of about one-sixteenth of an inch. A laterally longer length and a longitudinally longer length (for a lighter clamp) is also satisfactory. Standard paper clip wire known to the industry is satisfactory. Other metallic or composite wire is also satisfactory. Any overall size in combination with a suitable wire diameter, fit for human hands, is satisfactory. Wire diameters will vary depending on a wire rigidity or an amount of wire spring quality.

OPERATION

First Embodiment, FIG. 3A-FIG. 3H

A longitudinal end of body 10 opposite splines 12, 14 is used as a tongue and is capable of being applied to a side or major planar face of sheet material M. End portions 16, 18 are urged to the other side or opposing major planar face of sheet material M with such as a finger (FIG. 3A). Sliding into place, spline portions 12, 14 engage sheet material M providing a primary double clamping effect (FIG. 3B). Only one end portion, for example, end portion 16, may be urged to a side or major planar face of sheet material M, and a single clamping effect is present (FIG. 3C). Two documents d1 and d2, may be held separately with two single clamping effects (FIG. 3G). Each of end portions 16, 18 may be moved or flipped to an opposing planar face of middle portion 10 by an operator (FIG. 3F). For increasing holding strength, end portions 16, 18 may be moved or flipped laterally inward, from an original major planar face of body 10, to an opposing planar face of body 10 (FIG. 3F). End portions 16, 18 are pushed or manually bent away from the back side or opposing major planar face of body 10 (FIG. 3E). End portions 16, 18 are brought back to rest on the original major planar face of body 10 (FIG. 3E, FIG. 3H). Having increased holding strength, spring load, or potential energy, the clamp is ready to be applied to sheet material M (FIG. 3E, FIG. 3A). Whether or not a clamp is made for a consumer having an inherent certain amount of holding strength, potential energy or spring load, an operator is always able to manually adjust holding strength, spring load, or potential energy at will (FIG. 3E).

Reverse Loop Embodiment

FIG. 4

End portions 16*rv*, 18*ry* are running in reverse directions as clockwise vs. counter clockwise (FIG. 4).

OPERATION

Reverse Loop Embodiment, FIG. 3A-FIG. 3H

This Reverse Loop embodiment operates the same as the First embodiment (FIG. 3A-FIG. 3H).

Simple Loop Embodiment

FIG. 5

End portions 161*p*, 181*p* are rounding (FIG. 5).

OPERATION

Simple Loop Embodiment, FIG. 3A-FIG. 3H

Operation of a Simple Loop embodiment is the same as the First embodiment (FIG. 3A-FIG. 3H).

A Narrowing Loop Embodiment

FIG. 6

End portion 16*nlp* loop size is narrowing to form a "d" shape, and end portion 18*nlp* loop size is narrowing to form a "b" shape (FIG. 6).

OPERATION

Narrowing Loop Embodiment, FIG. 3A-FIG. 3H

Operation of this Narrowing Loop embodiment is the same as the First embodiment (FIG. 3A-FIG. 3H).

Heart Embodiment

FIG. 7

Spline portions 12*ht*, 14*ht* are rounding. An overall heart shape is being made (FIG. 7).

OPERATION

Heart Embodiment, FIG. 7, FIG. 3A-FIG. 3H

Operation of this Heart embodiment is the same as the First embodiment. (FIG. 7, FIG. 3A-FIG. 3H).

"U" Shape Body Embodiment

FIG. 8

This embodiment is narrowing in sheet material capacity, for a given overall length in comparison to the First Embodiment. This narrowing capacity is due to middle portion 10*u* forming a "U" shape (FIG. 1A, FIG. 8). Exemplary end portions shown are "d" shape and "b" shape (FIG. 8).

OPERATION

"U" Shape Body Embodiment, FIG. 3A-FIG. 3H

Operation of this "U" Shape body embodiment is the same as the First Embodiment (FIG. 3A-FIG. 3H).

Rectangular Embodiment

FIG. 9

Body 10*r* forms a squaring "U" shape. Exemplary end portions shown are triangular loops (FIG. 9).

OPERATION

Rectangular, FIG. 3A-FIG. 3H

Operation of this Rectangular embodiment is the same as the First embodiment (FIG. 3A-FIG. 3F).

Double Gem Embodiment

FIG. 10*a*

Exemplary end portions 16*dg*, 18*dg* are open ended with "U" shapes. Exemplary spline portions 12*dg*, 14*dg* shown are rounding (FIG. 10A). Contact in this embodiment has two points of contact 26*dg*, 28*dg* with the body 10*dg*.

OPERATION

Double Gem Embodiment, FIG. 3A-FIG. 3H FIG. 10B

Operation of this Double Gem embodiment is the same as the First Embodiment. (FIG. 3A-FIG. 3H, FIG. 10B).

Squaring Double Embodiment Gem

FIG. 11

"U" shape end portions 16*sq*, 18*sq* are squaring. Middle portion 10*sq* is a squaring "U" shape. A connector 24*sq*, having two bends, connects leg 20*sq* to leg 22*sq*.

OPERATION

Squaring Double Gem Embodiment

FIG. 3A-FIG. 3H

This Squaring Double Gem embodiment operates the same as the First Embodiment (FIG. 3A-FIG. 3H).

Triangular Double Gem Embodiment

FIG. 12

Exemplary spline portions 12*hdg*, 14*hdg* shown are straight. Exemplary end portions 16*hdg*, 18*hdg* shown are "U" shapes.

OPERATION

Triangular Double Gem, FIG. 3A-FIG. 3H

This embodiment operates the same as the First Embodiment (FIG. 3A-FIG. 3H).

Alien Embodiment

FIG. 13

End portions 16*a*, 18*b* are narrowing in loop size, body 10*a* is forming a rounding "V" shape, and spline portions 12*a*, 14*a* are rounding to form an overall alien cartoon character depiction.

OPERATION

Alien Embodiment, FIG. 3A-FIG. 3H

An Alien embodiment operates the same as the First Embodiment. (FIG. 3A-FIG. 3H)

Music Notes Embodiment

FIG. 14

This embodiment has end portions 16 nm, 18 nm together forming a symbol of music notes.

OPERATION

Music notes, FIG. 3A-FIG. 3H

This Music Notes embodiment operates the same as the First Embodiment (FIG. 3A-FIG. 3H).

Two Parallel Plane End View

FIG. 15, FIG. 1B, FIG. 3D, FIG. 6

This end view is exemplary of any embodiment having two end portions 16*pl*, 18*pl* forming a plane parallel with body 10*pl* plane. A parallel planar orientation such as FIG. 15 is shown as interchangeable with the planar orientation of FIG. 1 B, being recognizable as spline portions 12, 14 being adjusted out of plane with body 10 (this brings end portions 16, 18 into a plane parallel with body 10) Conversely, flattening spline portions 12*pl*, 14*pl* into plane with body 10*pl* returns parallel portions to the orientation of FIG. 1B. FIG. 3D is recognizable as the same interchangeability, only to do with the opposing major planar face of body 10 or body 10*pl*. End portions 16*pl*, 18*pl* each make two points of contact 26*pl*, 28*pl* with respective legs 20*pl*, 22*pl*.

Laterally Adjacent End Portion Example

FIG. 16

This illustration is exemplary of how two end portions 16*ad*, 18*ad* laterally adjacent to each other, contiguous or touching, is also satisfactory (FIG. 16).

OPERATION

Laterally Adjacent End Portion Example (FIG. 3A-FIG. 3H)

This exemplary embodiment functions the same as the First Embodiment.

Plastic Embodiment Example (FIG. 17)

This illustration is showing how an embodiment may be made of plastic, most likely being molded. At present, seen is an embodiment such as this one being about one-sixteenth of an inch thick or less for an overall clip size of about one and one-half inch by about one and one-half inch. Thickness of plastic will vary depending on plastic rigidity.

OPERATION

Plastic Embodiment Example FIG. 3A-FIG. 3H

Plastic embodiments may hold lighter, depending on thickness and rigidity of plastic.

ADVANTAGES

The present clamp has advantages of an adjustably strong hold, down to single sheet of paper versatility with minimal paper dimpling or wrinkling, high capacity in many cases, paper friendliness, stackable paper packets, non-tangling with others in a box or bag, ability to be made in any size fit for human hands, a novel flip function, a long lasting quality, and a unfathomable number of forms or embodiments.

CONCLUSION, RAMIFICATION, SCOPE

Uses for the present clamp technology include paper clamping, bag closure, securing mail packets, book marking, money clamping, or other sheet material clamping. Various colors made of plastic, vinyl, metallic or composite wire, or other material known to the industry is applicable. Metallic gold finish, chrome, or other metallic or composite wire is also satisfactory. Any overall size fit for human hands is satisfactory.

Thus the reader will see that at least one embodiment of the present patent provides a more paper friendly, more versatile, stronger, yet economical device able to be used by persons of almost any age. While my above description contains much specificity, this should not be construed as limiting the scope of the embodiment but rather as merely providing illustrations of some of the presently preferred embodiments. For example, other embodiments of different combinations of portions are also satisfactory. End portions may be spirals instead of loops. An overall shape may be circular, square, oval, trapezoidal, etc. Other symbols besides music notes are applicable. An animal head instead of an alien is also satisfactory, other cartoon characters besides Alien etc.

Thus the scope of the embodiment should be determined by the appended claims and their legal equivalents, rather than by the examples given.

I claim:

1. A clamp being formed of a length of metallic or composite wire primarily for securing superimposed paper or sheet material, the clamp further comprising:

two independent planar end portions each overlapping two respective legs, a connector having at least one bend connecting said legs, a planar body consisting of said legs and said connector, two spline portions disposed between respective said end portions and said body, said clamp being capable of being loaded with potential energy in a free state, each of said end portions having two points of contact with each of said respective legs, said end portions capable of being inwardly moved or flipped to an opposing major planar face of said body, said end portions being capable of a manual adjustment of holding strength, spring load or potential energy, an end of said body being capable of use as a tongue applicable to a major planar face of said paper or sheet material, both of said end portions capable of being urged to an opposing major planar face of said paper or sheet material with a finger for providing a primary double clamping effect.

2. The clamp of claim 1, wherein said end portions are capable of being individually applied to said opposing major planar face of said paper or sheet material thereby providing multiple single clamping effects.

3. The clamp of claim 1, wherein said clamp is capable of being made to have an inherent amount of holding strength, spring load, or potential energy.

4. The clamp of claim 1, wherein said clamp forms a symbol.

5. The clamp of claim 1, wherein said clamp forms a character.

6. A clamp being formed of a length of metallic or composite wire primarily for securing superimposed paper or sheet material, the clamp further comprising:

two independent planar end portions each overlapping two respective legs, a connector having at least one bend connecting said legs, a body consisting of said legs and said connector, two independent spline portions disposed between respective said end portions and said body, said clamp capable of being loaded with potential energy in a free state, each of said end portions having two points of contact by each of said end portions with each of respective legs, said end portions capable of each being inwardly moved or flipped to an opposing major planar face of said body, said end portions being capable of a manual adjustment of holding strength, spring load or potential energy, an end of said body being capable of use as a tongue applicable to a major planar face of at least one sheet of said paper or sheet material, both of said end portions capable of being urged to an opposing major planar face of said paper or sheet material with a finger for providing a primary double clamping effect, each of said end portions capable of being urged individually to a major planar face of said paper or sheet material, thereby providing multiple independent single clamping effects.

7. The clamp of claim 6, wherein said body forms "V" shape, and wherein each of said end portions form a loop.

8. The clamp of claim 7, wherein said end portions form a "d" shape and a "b" shape.

9. The clamp of claim 6, wherein said end portions each form a "U" shape.

10. The clamp of claim 6, wherein said body forms a "U" shape, and wherein each of said end portions form a loop.

11. The clamp of claim 10, wherein said end portions form a "U" shape.

12. The clamp of claim 10, wherein said end portions form a "d" shape and a "b" shape.

13. The clamp of claim 6, wherein said clamp forms a symbol.

14. The clamp of claim 6, wherein said clamp forms a character.

15. A method of clamping sheet material, comprising the steps of:

(a) providing a clamp being formed of a length of metallic or composite wire being primarily for securing superimposed paper or sheet material, the clamp further comprising:

two independent planar end portions each overlapping two respective legs, a connector having at least one bend and connecting said legs, a body consisting of said legs and said connector, two spline portions disposed between respective said end portions and said body, said clamp capable of being loaded with potential energy in a free state, each of said end portions having two points of contact against each of respective said legs, an end of said body longitudinally disposed opposite said splines and being capable of use as a tongue;

(b) moving or flipping said end portions from a major planar face of said body to an opposing major face of said body;

(c) bending said end portions away from the opposing major planar face of said body, such that the end portions are brought back to rest on the original major planar face of said body, thereby increasing a holding power, spring load, or potential energy of said clamp; and (d) applying said tongue to a major planar face of at least one sheet of said paper or sheet material, said end portions being urged to an opposing major planar face of said paper or sheet material with such as a finger thereby double clamping; and wherein when either one of said end portions is applied to an opposing major planar face of said paper or sheet material, said one end portion provides a single clamping.

* * * * *

UNITED STATES PATENT AND TRADEMARK OFFICE

CERTIFICATE OF CORRECTION

PATENT NO. : 8,925,157 B2
APPLICATION NO. : 12/807209
DATED : January 6, 2015
INVENTOR(S) : O'Daniel It is certified that error appears in the above-identified patent and that said Letters Patent is hereby corrected as shown below:

On the title page item [57], should read-- In accordance with at least one embodiment, a clamp is being formed of a length of metallic or composite wire, primarily for securing a plurality of paper or sheet material.

Signed and Sealed this
Third Day of March, 2015

Michelle K. Lee

Michelle K. Lee
*Deputy Director of the United States Patent and Trademark Office*